US006883684B2

(12) United States Patent
Jeter et al.

(10) Patent No.: US 6,883,684 B2
(45) Date of Patent: Apr. 26, 2005

(54) HOT MELT ADHESIVE SYSTEM HAVING CENTRALIZED MANIFOLD AND ZONE HEATING CAPABILITY

(75) Inventors: David R. Jeter, Woodstock, GA (US); David F. Andel, Lawrenceville, GA (US)

(73) Assignee: Nordson Corporation, Westlake, OH (US)

( * ) Notice: Subject to any disclaimer, the term of this patent is extended or adjusted under 35 U.S.C. 154(b) by 59 days.

(21) Appl. No.: 10/278,394

(22) Filed: Oct. 23, 2002

(65) Prior Publication Data

US 2003/0080156 A1 May 1, 2003

Related U.S. Application Data

(60) Provisional application No. 60/345,886, filed on Oct. 29, 2001, and provisional application No. 60/345,887, filed on Oct. 29, 2001.

(51) Int. Cl.[7] ..... B67D 5/62

(52) U.S. Cl. ..... 222/146.2; 222/146.5; 222/330

(58) Field of Search ..... 222/146.5, 146.2, 222/135, 330, 333, 504; 239/135, 562–564; 118/302; 137/341

(56) References Cited

U.S. PATENT DOCUMENTS

| | | | | | |
|---|---|---|---|---|---|
| 3,792,801 | A | * | 2/1974 | Baker et al. | 222/146.5 |
| 3,981,416 | A | * | 9/1976 | Scholl | 222/146.1 |
| 4,328,387 | A | * | 5/1982 | Kemble | 219/517 |
| 4,485,941 | A | | 12/1984 | Frates | |
| 4,485,942 | A | * | 12/1984 | Petrecca | 222/146.5 |
| 4,790,455 | A | * | 12/1988 | Dieringer et al. | 222/146.2 |
| 5,495,963 | A | * | 3/1996 | Miller et al. | 222/318 |
| 5,735,588 | A | | 4/1998 | Dittman et al. | 312/330 |
| 6,155,806 | A | | 12/2000 | Andel | 417/523 |

FOREIGN PATENT DOCUMENTS

| | | | | |
|---|---|---|---|---|
| DE | 9310427 | | 11/1994 | |
| EP | 0107077 | A | 5/1984 | |
| EP | 0333233 | A | 9/1989 | |
| EP | 0771631 | A | 5/1997 | |
| EP | 0872284 | A | 10/1998 | |
| GB | 0107077 | A1 * | 2/1984 | B05C/9/14 |

* cited by examiner

*Primary Examiner*—Frederick Nicolas
(74) *Attorney, Agent, or Firm*—Wood, Herron & Evans, L.L.P.

(57) ABSTRACT

A dispensing unit for a hot melt adhesive system has a manifold centrally located within the dispensing unit to permit commonality between heated hoses of substantially the same length used to supply adhesive guns at either side of the dispensing unit. The dispensing unit also includes a manifold that is thermally isolated from the adhesive tank. The manifold has a heater that is independent of the tank heater for more precise temperature control of adhesive flowing through the manifold. A pump coupled to the manifold is located external to the tank and is heated by the manifold heater.

14 Claims, 3 Drawing Sheets

HOT MELT ADHESIVE SYSTEM HAVING CENTRALIZED MANIFOLD AND ZONE HEATING CAPABILITY

CROSS-REFERENCE TO RELATED APPLICATIONS

This application claims the benefit of U.S. Provisional Application Nos. 60/345,886 and 60/345,887 both filed on Oct. 29, 2001, and the disclosures of which are hereby incorporated by reference herein.

FIELD OF THE INVENTION

The present invention pertains to dispensing systems for dispensing flowable material, and more particularly to hot melt adhesive dispensing systems.

BACKGROUND OF THE INVENTION

Thermoplastic adhesives, otherwise known as "hot melt" adhesives have been widely used in industry for adhering many types of products. Hot melt adhesive dispensing systems generally include one or more dispensing guns, heated hoses connected to the guns, and a dispensing unit for melting and supplying heated liquid adhesive to the guns through the heated hoses. The dispensing units of conventional hot melt adhesive systems include a tank, a heater, a pump, a manifold, and a controller. The heater is located in a base of the tank and the tank is mounted on top of the manifold so that the heater can heat both the tank and the manifold. The manifold has an inlet connected to the tank and typically has multiple outlet ports for connection to the heated hoses. Adhesive material is supplied to the tank in solid or semi-solid form, where it is melted and heated to a desired application temperature. The pump associated with the tank and manifold pumps liquid adhesive from the tank, through the manifold and heated hoses to the dispensing guns. The controller is generally located adjacent the tank and controls the power supplied to the heater and heated hoses to maintain the liquid adhesive at an appropriate viscosity and temperature, depending on the application. The controller typically controls many other system operations as well.

While conventional dispensing units for hot melt adhesive systems, as described above, have been in use for many years, improvements in design are still needed. For example, the location of the manifold beneath the tank creates an asymmetric layout wherein the heated hoses connecting the outlet ports of the manifold to the adhesive guns must be of different length depending upon whether the gun is located adjacent the tank or on an opposite side of the dispensing unit adjacent the controller. This asymmetry can be problematic when a single dispensing unit is positioned between two manufacturing lines to supply adhesive to the two lines. It can also be problematic if separate dispensing units are used to supply separate manufacturing lines. In each case, as a consequence of the asymmetry of current dispensing units, end users must purchase and stock heated hoses of various lengths to accommodate various arrangements of dispensing systems.

Also, utilizing a common heater to heat both the tank and the manifold can expose the adhesive flowing through the manifold to more heat than is often necessary for maintaining proper adhesive viscosity and temperature. This is especially problematic when the heater is energized to melt solid or semi-solid adhesive that has been added to the tank during operation when the tank level is low. This problem is sometimes referred to as thermal shock and is caused by the control system's attempt to rapidly melt the relatively cool, solid or semi-solid adhesive added by the operator. The rapid, increased heating can cause undesirable charring and degradation of adhesive in the manifold and thereby cause various adhesive performance problems.

Another challenge with conventional hot melt adhesive systems relates to the time period needed to heat the pump to operating temperature at start-up. Since the pump is located within the tank, it is only indirectly heated by the hot adhesive in the tank. This typically lengthens the start-up time. Location of the pump in the tank also minimizes the adhesive holding capacity of the tank and limits the size of the effective tank opening for receiving new adhesive into the tank.

For at least these reasons, a need exists for a dispensing unit of a hot melt adhesive system having a configuration allowing the user to stock heated hoses of more uniform length. A need also exists for a dispensing unit for a hot melt adhesive system which facilitates more precise temperature control of adhesive flowing through the manifold and which heats the pump faster at start-up.

SUMMARY OF THE INVENTION

The present invention provides a dispensing unit for a hot melt adhesive system in which the supply hose connections to the adhesive supply manifold are located centrally between right and left sides of the unit. The invention provides advantages in that a common length of heated hose may be used to provide liquid adhesive to one or more manufacturing lines. End users need only purchase and stock a single length of hose for use on different installations of adhesive dispensing systems. The design also improves accessibility of the heated hose cord sets to electrical connections on the controller and significantly reduces the vertical envelope or space occupied by the unit.

More specifically, the dispensing unit for a hot melt adhesive system includes a tank, a manifold, and a controller. The manifold is located adjacent the tank and is positioned between the tank and the controller. Outlet ports on the manifold are arranged to be substantially centrally located with respect to the tank-side and controller-side ends of the unit. Because the manifold is no longer located beneath the tank, the overall height of the dispensing unit may be reduced to provide a shorter service envelope. Another benefit is that a conventional pump, such as a piston pump may be located outside of the tank. This permits easier serviceability of the pump and vertical pump orientation which results in better pumping action. Removing the pump from the tank also maximizes the tank opening and capacity by eliminating the obstruction created by the pump within the tank.

In another aspect, the manifold of the dispensing unit is thermally isolated from the tank and has an independently controllable manifold heater. The temperature of the adhesive flowing through the manifold may therefore be more precisely controlled to ensure that hot melt adhesive is supplied to the adhesive guns at the proper viscosity and temperature. Specifically, controlling the manifold temperature and tank temperature independently prevents undesirable charring and degradation of the adhesive in the manifold especially when relatively cool adhesive is added to the tank. Excessive heat build-up in the manifold is prevented ensuring that the manifold is always maintained at an appropriate application temperature.

In another aspect of the invention, a pump coupled to the manifold is located outside of the tank and is thermally coupled to the manifold so that it is heated by the manifold heater. This arrangement permits the adhesive holding capacity of the tank to be maximized and provides more direct heating of the pump for shorter start-up times.

In yet another aspect of the invention, the manifold heater is easily removable from the manifold to facilitate maintenance or replacement of the heater.

These and other features, advantages and objectives of the invention will become more readily apparent to those of ordinary skill in the art upon review of the following detailed description of the preferred embodiments, taken in conjunction with the accompanying drawing.

BRIEF DESCRIPTION OF THE DRAWINGS

The accompanying drawing, which is incorporated in and constitutes a part of this specification, illustrates embodiments of the invention and, together with a general description of the invention given above, and the detailed description given below, serves to explain details of the preferred embodiment.

DETAILED DESCRIPTION

Figure 1:
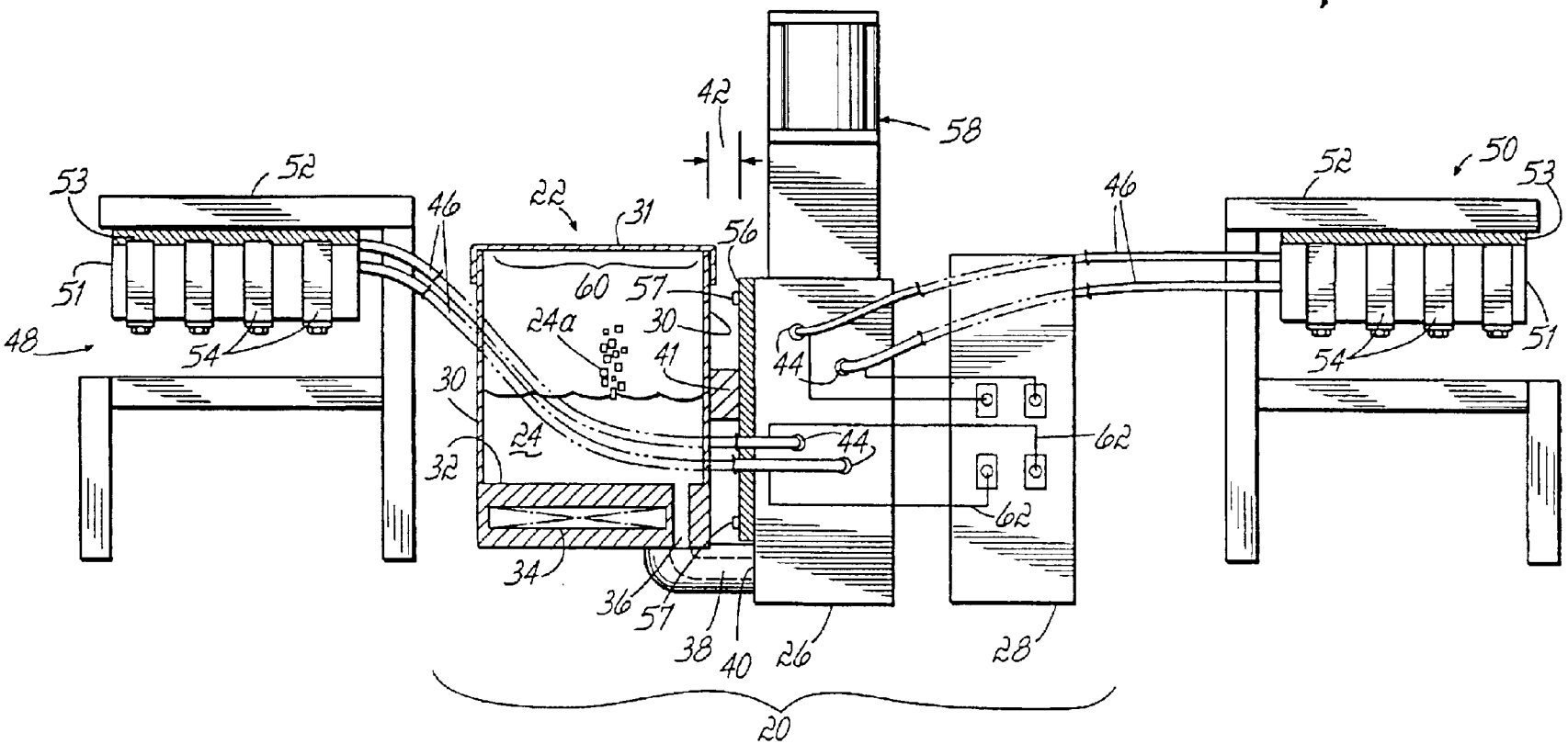
FIG. 1 is a schematic drawing of a hot melt adhesive system including a dispensing unit incorporating the principles of the present invention.

Referring to FIG. 1, a hot melt adhesive system 10 is shown, including a dispensing unit 20 which incorporates principles of the present invention. The dispensing unit 20 includes a tank 22 for receiving and melting solid or semi-solid adhesive material 24*a*, a manifold 26 connected to the tank 22, and a controller 28. The tank 22 comprises side walls 30, a removable cover 31, and base 32 which includes one or more tank heaters 34 for melting and heating the liquid adhesive material 24 in the tank 22. The base 32 may be integral with the tank 22 and one or more heaters 34 may be cast in place. A tank outlet 36 proximate the base 32 is coupled to a passage 38 which connects to an inlet 40 of the manifold 26.

The manifold 26 is mounted to a side wall 30 of the tank 22 with a spacer 41 and is spaced from the tank 22 a distance 42 sufficient to provide thermal isolation of the tank 22 and manifold 26. In an exemplary embodiment, the spacer 41 is made from aluminum. A vertically-oriented piston pump 58 coupled to the manifold 26 pumps liquid adhesive 24 from the tank 22 and into the manifold 26 where it is split into separate flows. The manifold 26 has a plurality of outlet ports 44 which may be fitted with heated hoses 46 attached to one or more adhesive guns 48, 50 to supply the liquid adhesive 24 to the guns 48, 50.

The guns 48, 50 include one or more adhesive dispensing modules 54 which apply the adhesive 24 to a desired product (not shown). The adhesive dispensing modules 54 are mounted to gun bodies 51 having gun heaters 53 and are supported on a frame 52. The hot melt adhesive system 10 shown in FIG. 1 includes two guns 48, 50, one located on each side of the dispensing unit 20 although different numbers and configuration may be used instead.

As shown in FIG. 1, the manifold 26 is located adjacent the tank 22, between the tank 22 and the controller 28. It will be appreciated that other configurations in which the manifold 26 is centrally located on unit 20 may be utilized as well. The outlet ports 44 on the manifold 26 are arranged substantially in the center of the dispensing unit 20 so that the distances from a given outlet port 44 to either the tank-side or the controller-side of the unit 20 are substantially the same. This centralized arrangement of outlet ports 44 permits the same length of hose 46 to be utilized to supply liquid adhesive 24 to dispensing lines 48, 50 located on either side of the dispensing unit 20.

The manifold 26 includes a manifold heater 56 which is separate from the tank heater 34 and which can be independently controlled by the controller 28. Because the dispensing unit 20 of the present invention has a separate manifold heater 56 and a manifold 26 which is thermally isolated from the tank 22, the temperature of the adhesive 24 flowing through the manifold 26 may be controlled more precisely than prior systems which utilized a single heater to perform both the function of melting and heating adhesive 24 in the tank 22 and the function of heating the manifold 26. Moreover, the separate manifold heater 56 eliminates or significantly reduces the possibility of overheating the adhesive 24 in the manifold 26 when the tank heater 34 is energized to melt relatively cool solid or semi-solid adhesive 24*a* that has been newly added to the tank 22.

Another benefit of utilizing a separate tank heater 34 and manifold heater 56 is that the design of the heating elements may be simplified and may even be available as off-the-shelf stock items. The manifold heater 56 may also be configured to be easily removable from the manifold 26, such as by removing bolts 57 which are used to fasten the manifold heater 56 to the manifold 26. While the manifold heater 56 is depicted as being bolted to the manifold 26 in FIG. 1, it is understood that the manifold heater 56 may be attached to the manifold 26 by other methods. The ability to easily remove the manifold heater 56 facilitates servicing of the manifold 26 or the manifold heater 56.

In another aspect of the invention, the pump 58 is located external to the tank 22. Pump 58 is preferably attached to the manifold 26 and is heated by the manifold heater 56. This arrangement permits a larger tank opening 60, increases the tank capacity, and reduces the time required to heat the pump 58. It also allows the piston (not shown) of pump 58 to move vertically which provides for better pumping action.

Dispensing unit 20 includes a controller 28 which houses the power supply and electronic controls for the dispensing unit 20. The heated hoses 46 are electrically coupled to the controller 28 by cord sets 62 associated with each hose 46. The controller 28 preferably independently monitors and adjusts the tank heater 34, the manifold heater 56, the heated hoses 46, and the gun heater(s) 53 to melt solid or semi-solid adhesive 24*a* received in the tank 22 and to maintain the temperature of melted adhesive 24 to ensure proper viscosity of the adhesive 24 supplied to the guns 48, 50 and dispensed by the adhesive dispensing modules 54.

Figure 2:
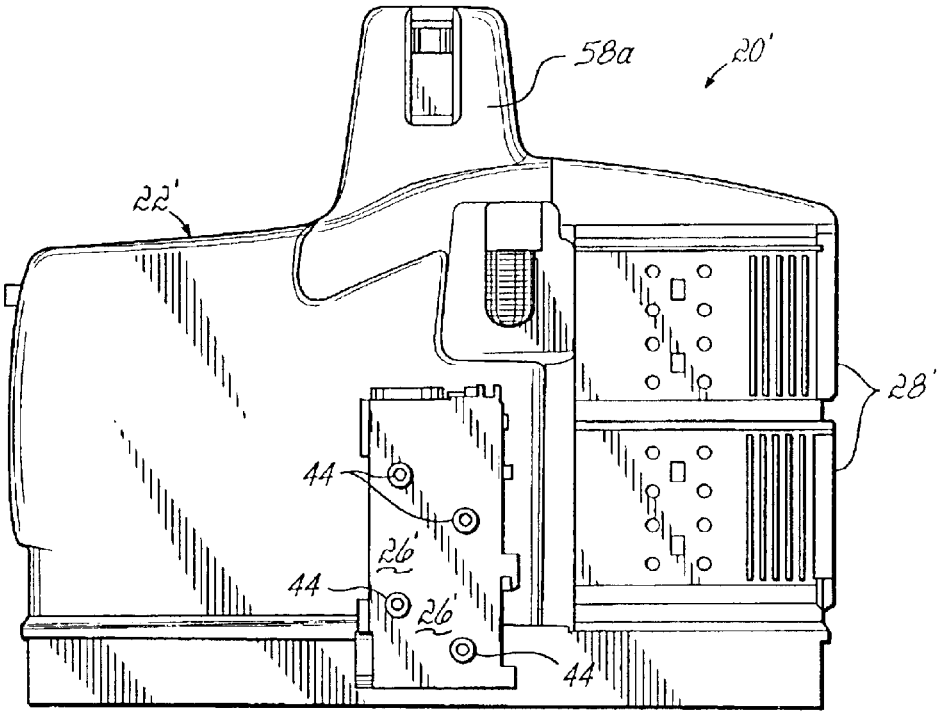
FIG. 2 is a rear elevational view of a first embodiment of the dispensing unit.
Figure 3:
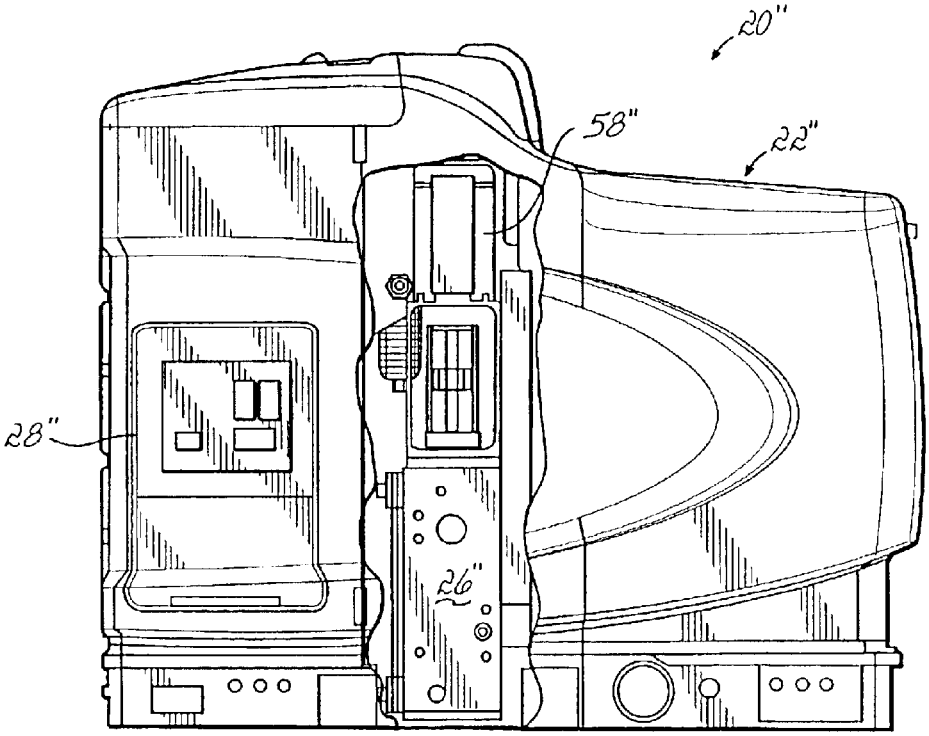
FIG. 3 is a front elevational view of a second embodiment of the dispensing unit partially broken away to show the pump and manifold.

FIGS. 2 and 3 illustrate respective preferred embodiments of dispensing units 20', 20", with the difference between these two units being primarily small versus large capacity. FIG. 2 illustrates a rear view of a smaller capacity unit 20', while FIG. 3 illustrates a front view of a larger capacity unit 20" with the outer housing partially broken away to show the centrally located manifold 26" and pump 58". With respect to each of these embodiments, in accordance with the invention, the manifolds 26', 26" are centrally located between left and right sides of the units 20', 20". Preferably, manifolds 26', 26" are respectively positioned between the tanks 22', 22" and the controllers 28', 28". As with the schematic illustration of FIG. 1, a vertically oriented piston pump 58" is mounted to the front of manifold 26" and extends above manifold 26" (FIG. 3). Although not illustrated in FIG. 2, a similar vertically oriented piston pump is mounted to the front of manifold 26' beneath cover 58*a* and extends above manifold 26'. As further shown in FIG. 2, outlet ports 44 are provided on a rear side of manifold 26' for connection to suitable hoses (not shown). Similar outlet ports (not shown) are provided on the rear side of manifold 26".

Figure 4:
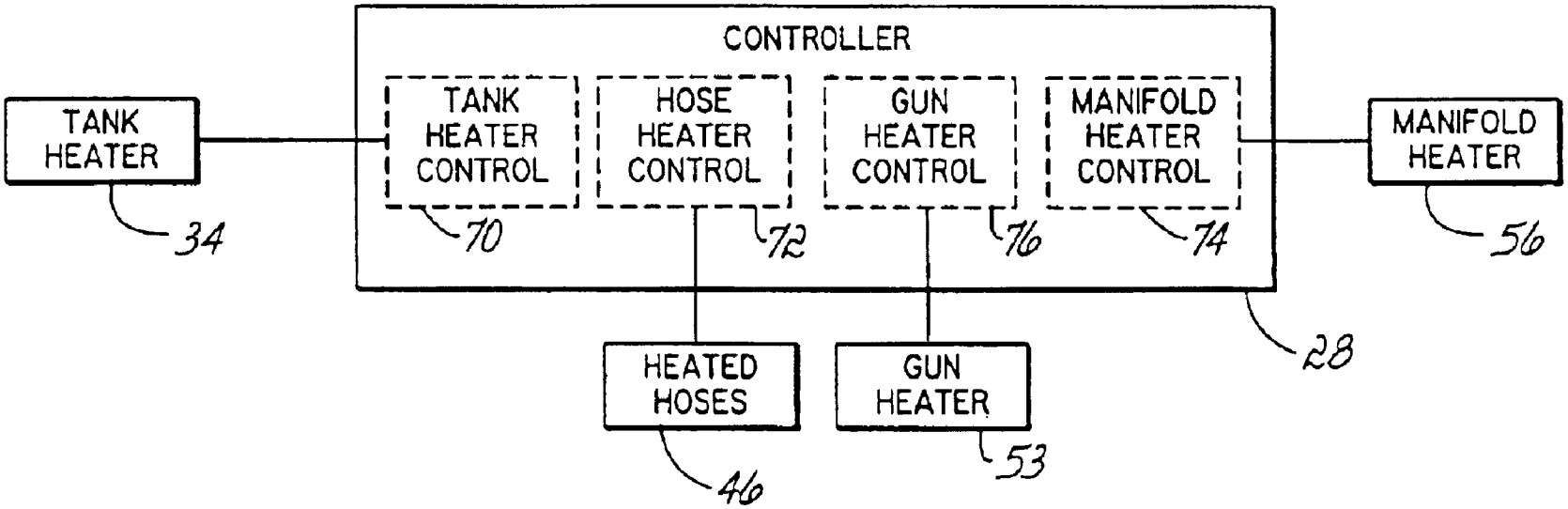
FIG. 4 is a block diagram illustrating the heater control system for the dispensing unit of the present invention.

The block diagram of FIG. 4 illustrates the controller connections with the manifold heater 56, the tank heater 34, heated hoses 46, and gun heater(s) 53. The controller 28 comprises individual controller sections 70, 72, 74, 76 electrically coupled to the tank heater 34, the heated hoses 46, the manifold heater 56, and the gun heaters 53, respectively. At start-up, the tank heater 34, manifold heater 56, and heated hoses 46 are fully energized to increase the temperature of each component to a predetermined set point temperature, generally between 350° F. and 400° F. When the temperatures of these components near their respective set point temperatures, gun heater control section 76 energizes the gun heaters 53 and the individual controller sections 70, 72, 74, 76 begin to cycle the tank heater 34, the manifold heater 56, the heated hoses 46, and the gun heater(s) 53, respectively, on and off to prevent undesirable overshoot and undershoot of the desired temperature. In this manner, the controller 28 provides a smooth increase to operating temperature which is then held throughout operation of the dispensing unit 20 by controller sections 70, 72, 74, 76 cycling their respective components on and off to maintain respective set point temperatures.

When new adhesive material 24*a* is added to the tank 22, tank heater control section 70 senses a drop in temperature and the tank heater 34 is cycled on to melt the newly added adhesive 24*a*, while the manifold 26, heated hoses 46, and adhesive guns 48, 50 are maintained at substantially constant temperature by the manifold heater control section 74, the heated hose control section 72, and the gun heater control section 76, respectively. Individual control of the temperature of the adhesive 24 in each component, as described above, ensures that liquid hot melt adhesive 24 is provided to the adhesive dispensing modules 54 at an appropriate application temperature and viscosity without exposing the adhesive 24 to excessive temperatures which could overheat and char or otherwise degrade the adhesive 24.

While the present invention has been illustrated by the description of various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A hot melt adhesive dispensing unit having left and right sides and comprising:

a tank having a heater and an interior adapted to heat and melt adhesive material;

a manifold having an inlet and a plurality of vertically spaced apart outlets, said inlet in fluid communication with said tank interior and each of said plurality of outlets adapted to be coupled to an electrically heated hose, said manifold positioned centrally between the left and right sides of said dispensing unit such that said plurality of outlets are substantially equidistant from the left and right sides; and a pump coupled to said manifold and positioned substantially equidistant from the left and right sides, said pump operative to pump liquid adhesive material through said manifold to the hoses.

2. The dispensing unit of claim 1, wherein said manifold is positioned between said tank and a controller.

3. The dispensing unit of claim 1, wherein said pump further comprises a piston pump oriented to operate in a vertically reciprocating manner.

4. The hot melt adhesive dispensing unit of claim 1 further comprising:

(a) a plurality of adhesive dispensing guns; and (b) a plurality of substantially equal length electrically heated hoses respectively coupled between said outlets and said adhesive guns.

5. The dispenser of claim 4, wherein said manifold is positioned between said tank and a controller for controlling the temperature of the adhesive.

6. The dispensing unit of claim 1, wherein said tank and said manifold are thermally isolated from one another.

7. The dispensing unit of claim 1, further comprising:

a manifold heater associated with said manifold; and a heater control operative to independently control said tank heater and said manifold heater.

8. The dispensing unit of claim 7, wherein the heater control maintains the tank temperature at a first setpoint and maintains the manifold temperature at a second setpoint.

9. The dispensing unit of claim 8, wherein said manifold heater is removable from said manifold.

10. The dispensing unit of claim 7, further comprising:

a controller operative to control said tank heater and said manifold heater, wherein said manifold is positioned between said tank and said controller.

11. The dispenser of claim 4, wherein said manifold includes a height and a width, said height being substantially greater than said width.

12. The dispensing unit of claim 1, wherein said manifold includes a height and a width, said height being substantially greater than said width.

13. A hot melt adhesive dispensing unit having left and right sides and comprising:

a tank having a heater and an interior adapted to heat and melt adhesive material;

a manifold having an inlet and a plurality of vertically spaced apart outlets, said inlet in fluid communication with said tank interior and each of said plurality of outlets adapted to be coupled to an electrically heated hose, said manifold positioned centrally between the left and right sides of said dispensing unit such that said plurality of outlets are substantially equidistant from the left and right sides;

wherein said manifold includes a height and a width, said height being substantially greater than said width.

14. A hot melt adhesive dispensing unit comprising:

a tank having at least one side wall and a bottom collectively defining a tank interior for receiving adhesive material;

a tank heater associated with said tank to melt and heat the adhesive material;

a manifold having an inlet and a plurality of vertically spaced apart outlets, said inlet in fluid communication with said tank interior and said plurality of outlets, said manifold spaced from said tank and said tank heater and positioned centrally between left and rights dies of the dispensing unit such that said plurality of outlets are substantially eguidistant from the left and right sides; and a manifold heater associated with said manifold, wherein said manifold includes a height and a width, said height being substantially greater than said width.

* * * * *

UNITED STATES PATENT AND TRADEMARK OFFICE

CERTIFICATE OF CORRECTION

PATENT NO. : 6,883,684 B2
DATED : April 26, 2005
INVENTOR(S) : David R. Jeter et al.

It is certified that error appears in the above-identified patent and that said Letters Patent is hereby corrected as shown below:

Column 3,
Line 12, change “drawing” to -- drawing --.
Line 16, change “drawing” to -- drawing --.
Line 16, change “is” to -- are --.
Line 17, change “constitutes” to -- constitute --.
Line 17, change “illustrates” to -- illustrate --.
Line 20, change “serves” to -- serve --.
Line 63, change “configuration” to -- configurations --.

Column 6,
Line 60, change “dies” to -- sides --.
Line 62, change “eguidistant” to -- equidistant --.

Signed and Sealed this

Ninth Day of August, 2005

JON W. DUDAS
*Director of the United States Patent and Trademark Office*